US005857904A

United States Patent [19]

Van Horn

[11] Patent Number: 5,857,904

[45] Date of Patent: Jan. 12, 1999

[54] CHIMNEY CAP

[75] Inventor: Samuel L. Van Horn, Bloomingburg, Ohio

[73] Assignee: Lyemance International, Jeffersonville, Ind.

[21] Appl. No.: 837,895

[22] Filed: Apr. 22, 1997

[51] Int. Cl.[6] ..... F23L 17/02

[52] U.S. Cl. ..... 454/4; 454/7

[58] Field of Search ..... 126/286; 454/4, 454/7

[56] References Cited

U.S. PATENT DOCUMENTS

| | | | |
|---|---|---|---|
| 944,831 | 12/1909 | Terramorse | 454/4 |
| 978,175 | 12/1910 | Lindenmeyer | 454/4 |
| 3,101,039 | 8/1963 | Duchene et al. . | |
| 3,267,832 | 8/1966 | Hinkle | 454/4 |
| 3,945,307 | 3/1976 | Lyemance . | |
| 4,007,730 | 2/1977 | Heebink | 126/286 |
| 4,020,754 | 5/1977 | Dalsin et al. | 454/4 |
| 4,181,119 | 1/1980 | Lyles . | |
| 4,368,663 | 1/1983 | Tabacco | 454/7 |
| 4,554,863 | 11/1985 | Dalsin . | |
| 5,094,050 | 3/1992 | Jenkins | 454/4 X |
| 5,125,869 | 6/1992 | VonSick . | |

FOREIGN PATENT DOCUMENTS

| | | | |
|---|---|---|---|
| 1 344 498 | 1/1974 | United Kingdom | 454/4 |

*Primary Examiner*—Harold Joyce
*Attorney, Agent, or Firm*—Scott R. Cox

[57] ABSTRACT

A chimney damper and cap system containing a support base securable to the top of a chimney flue, an increased air flow bracket containing a support tube opening, an inner support tube secured to the bottom of the chimney cap, an outer support tube into which the inner support tube is slidably engaged, an inner and outer spring substantially contained within the inner and outer support tube, wherein the inner spring is secured to the chimney cap, and a damper cable secured to the inner spring, wherein the outer spring biases the chimney cap to an open position.

15 Claims, 6 Drawing Sheets

CHIMNEY CAP

BACKGROUND OF INVENTION

1. Field of Invention

This invention relates to chimney dampers and chimney caps. More particularly, this invention relates to an improved chimney cap which uses a combination spring mechanism contained within closed slidable tubes to bias the chimney damper to an open position while also permitting the cap to be pulled to a closed position.

2. Prior Art

In homes and other buildings having a fireplace, the fireplace opening is connected to a chimney flue which is open to the outside of the building. When in use, the combustion products from the fireplace pass up through the flue and exit the chimney in a conventional fashion.

When the fireplace is not in use, however, the fireplace opening and chimney flue form a passage through which heat can escape from the interior of the building. Although most fireplaces contain conventional fireplace dampers at the bottom of the flue or immediately above the fireplace opening, these fireplace dampers do not usually provide an adequate seal to prevent heat loss through the chimney flue.

A number of different types of chimney dampers or chimney caps have been produced which are mounted on the top of the chimney to provide a better seal and thus reduce the amount of heat lost through the chimney flue. For example, one well known type of chimney damper is a cap-type flue damper as shown in U.S. Pat. Nos. 5,437,574, 5,387,151, 5,295,901, 5,125,869, 4,554,863, 4,181,119 and 4,020,754.

Another common type of chimney damper utilizes a lid attached to the side of the chimney by hinges, which lid closes the flue as shown, for example, in U.S. Pat. No. 4,368,663.

Another common type of chimney damper utilizes a frame secured to the top of the chimney containing a flap which is pivotally attached to the frame. This flap both closes the flue and prevents substantial quantities of either air or water from flowing over the damper flap into the chimney when the flap is in a closed position. See the particularly preferred devices shown in U.S. Pat. Nos. 3,945,307, 5,127,874 and 5,160,291.

Many chimney dampers also contain springs or other similar devices which may orient the chimney damper to an open position. See, for example, U.S. Pat. Nos. 3,101,039, 3,267,832, 3,945,307, 4,020,754, 4,181,119, 4,007,730, 5,094,050, 4,554,863, 5,125,869, 5,295,901 and 4,368,663.

A common problem that arises with conventional chimney dampers is a buildup of soot or creosote on the components of the chimney damper. This problem was addressed, for example, by the device disclosed in U.S. Pat. No. 4,554,863. In this device a spring is utilized to bias the chimney damper to an open position. The spring is secured between a bracket and the top portion of the chimney damper.

Another problem often encountered with complicated chimney damper systems is a reduction in the flow of air through the chimney because of the presence of numerous components of conventional chimney damper system.

Accordingly, it is an object of this invention to provide a chimney damper and cap system containing means to bias the chimney cap to an open position.

It is a still further object of the invention to provide a chimney damper and cap system containing a multiple spring system designed to bias the chimney cap to an open position.

It is a still further object of this invention to provide a chimney damper and cap system containing a closed, slidable tubular support system which supports the chimney cap when that the chimney damper and cap system is either closed or open.

It is a still further object of this invention to disclose a chimney damper and cap system containing a bracket to support a slidable tubular support system which reduces the restriction on flow of air through the chimney and the chimney damper and cap system.

It is an additional object of the invention to provide a chimney damper and cap system which utilizes a multiple spring system to bias the cap to an open position, which spring system is placed within a slidable tube system which reduces the exposure of the spring system to soot and creosote produced by fires in the chimney.

These and other objects are produced by the improved chimney damper and cap system of the instant invention.

SUMMARY OF INVENTION

The instant invention is an improved chimney damper and cap system whose components include a support base securable to the top of a chimney flue, an increased air flow bracket containing a support tube opening secured to the support base, an outer support tube secured within the support tube opening of the bracket, an inner support tube slidably engaged within the outer support tube, an inner and outer spring system contained within the inner and outer support tubes, wherein the inner spring is secured to the chimney cap and a damper cable secured to the inner spring or to the chimney cap, wherein the damper cable can be pulled to close the chimney cap against the support base.

Preferably, the outer spring of the inner and outer spring system is a compression spring and biases the chimney cap to an open position. The inner and outer springs are secured within the inner and outer support tube, preferably by securing the top end of the inner support tube to the bottom of the chimney cap and by crimping the bottom end of the outer support tube. By closing this bottom end of the outer support tube, buildup of creosote and soot on the springs is also substantially reduced. In addition, because of the design and working relationship of the inner support tube within the outer support tube, each time the chimney cap is closed, the sides of the inner support tube are cleaned by a scraping action of the top edge of the outer support tube against the sides of the inner support tube. Finally, the design of the increased air flow bracket reduces the resistance to the flow of air through the chimney damper and cap system.

BRIEF DESCRIPTION OF THE DRAWINGS

This invention will now be described with reference to the accompanying drawings in which.

DETAILED DESCRIPTION OF THE PREFERRED EMBODIMENT

Figure 1:
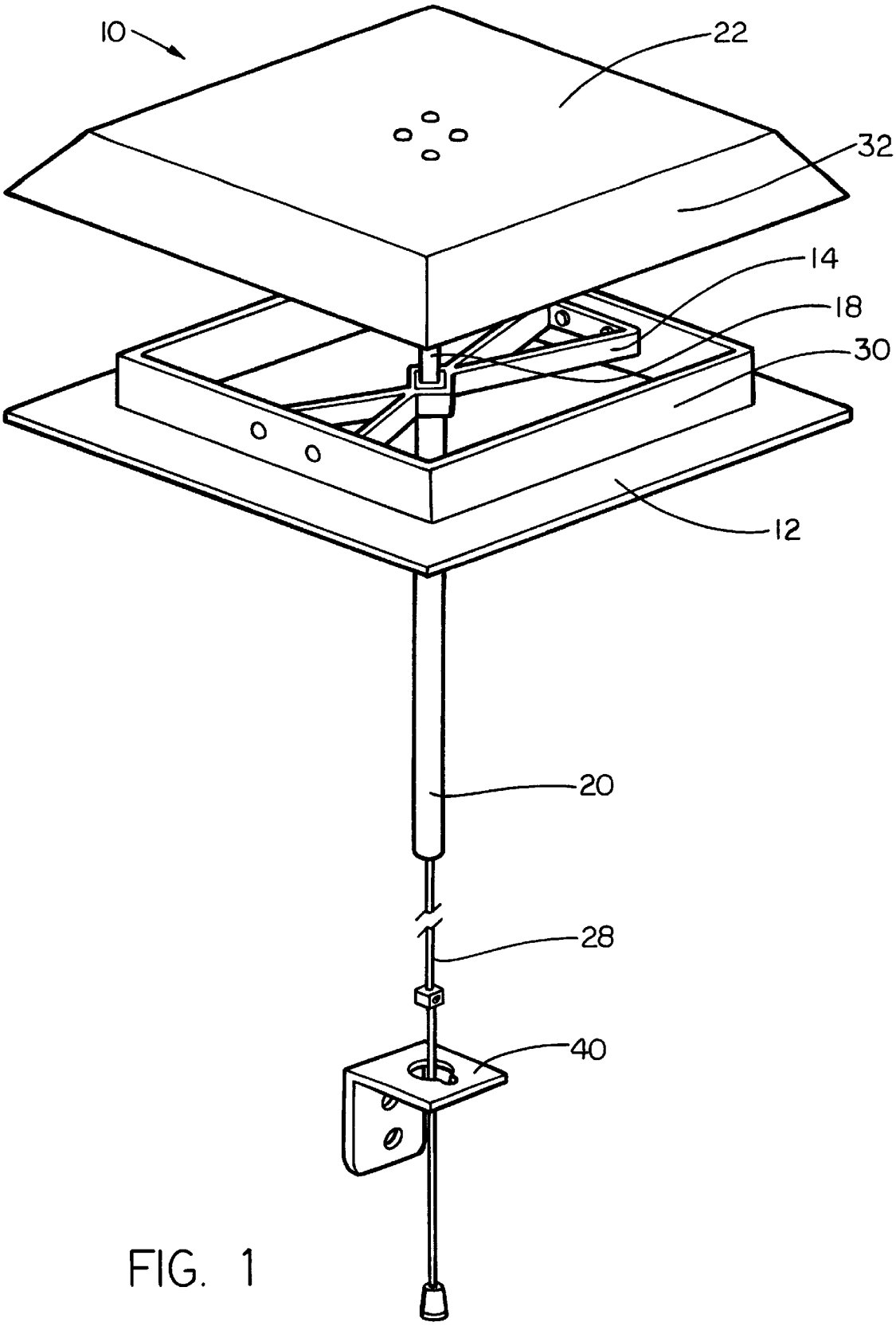
FIG. 1 is a perspective view of the improved chimney damper and cap system in accordance with the present invention with the chimney cap in an open position.
Figure 2:
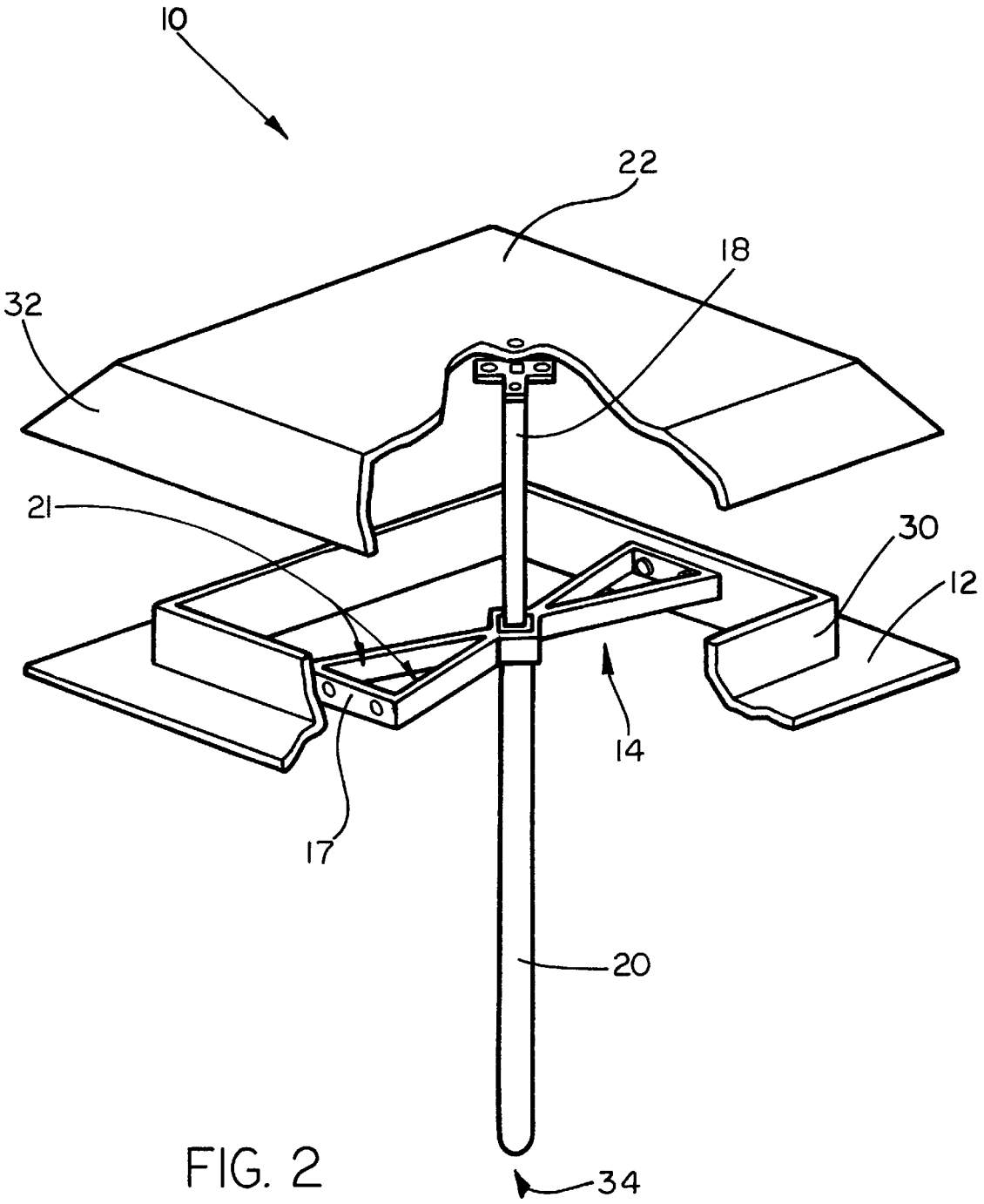
FIG. 2 is a partially cut away perspective view of the chimney damper and cap system of FIG. 1.
Figure 3:
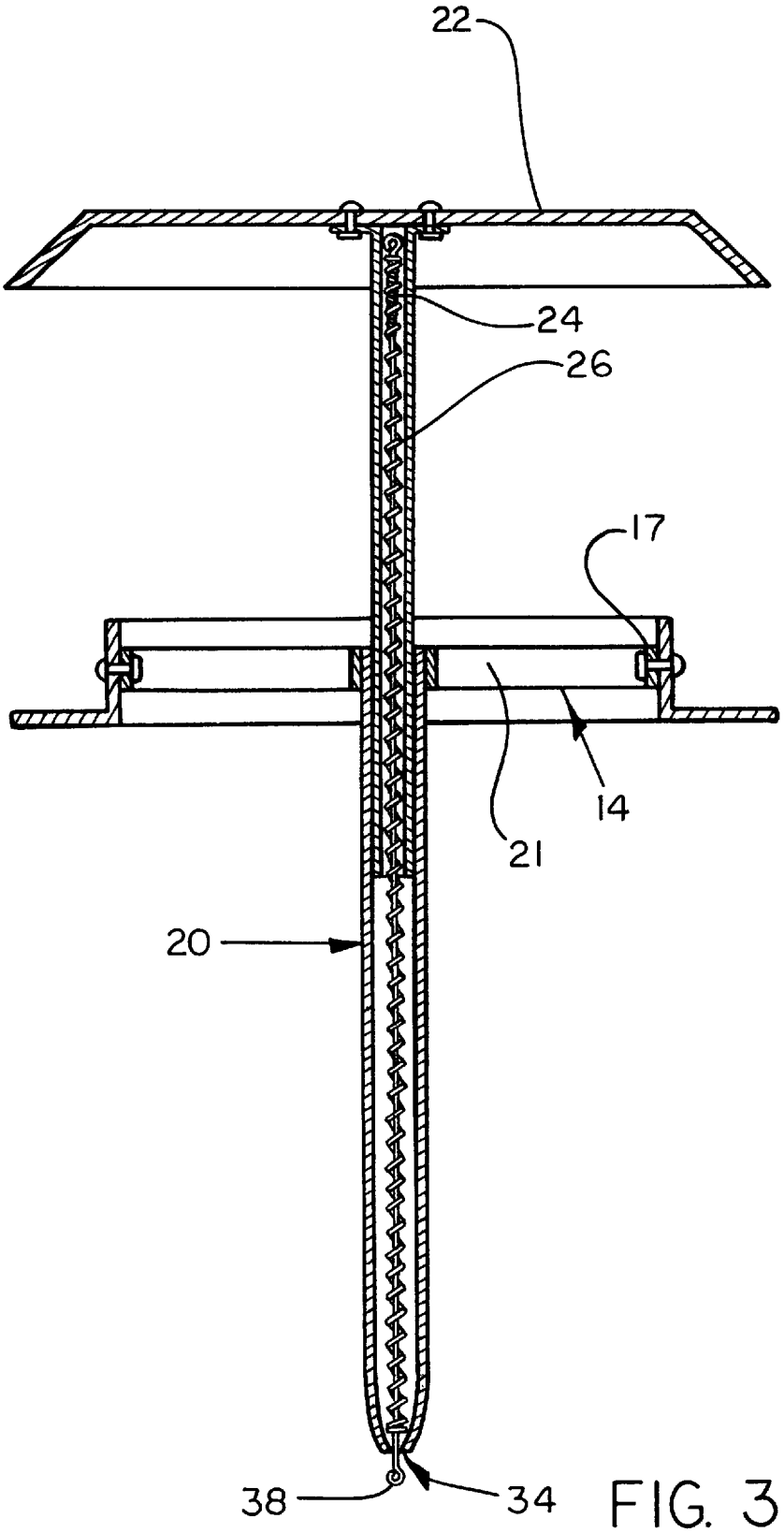
FIG. 3 is a cut away side view of the chimney damper and cap system showing an inner and outer spring system inside the support tubes.

Although the invention is adaptable to a wide variety of uses, it is shown in the drawings for purpose of illustration as an improved chimney damper and cap system (10) comprised of a support base (12), an increased air flow bracket (14), an inner (18) and outer (20) support tube, a chimney cap (22), an inner (24) and outer (26) spring system and a damper cable (28). See FIGS. 1, 2 and 3.

The support base (12) is designed to be secured to the top of the outlet of the flue of a chimney. The support base can be of any design limited only by the shape of the flue outlet. In one preferred embodiment, the support base (12) is rectangular in shape and includes an upstanding, inner flange (30). In an optional embodiment a sleeve (not shown) may be secured to the bottom of the support base (12) which fits within the chimney flue to provide additional support for the overall system (10). The support base (12) is secured to the flue by conventional means well known in the industry, such as by an adhesive or by bolting it in place.

Secured across the support base (12) is the specially designed, increased air flow bracket (14). See FIGS. 2 and 4A. This increased air flow bracket (14) contains an opening (16), preferably in its center, which opening (16) is designed to receive the inner and outer support tubes (18, 20).

Figure 4A:
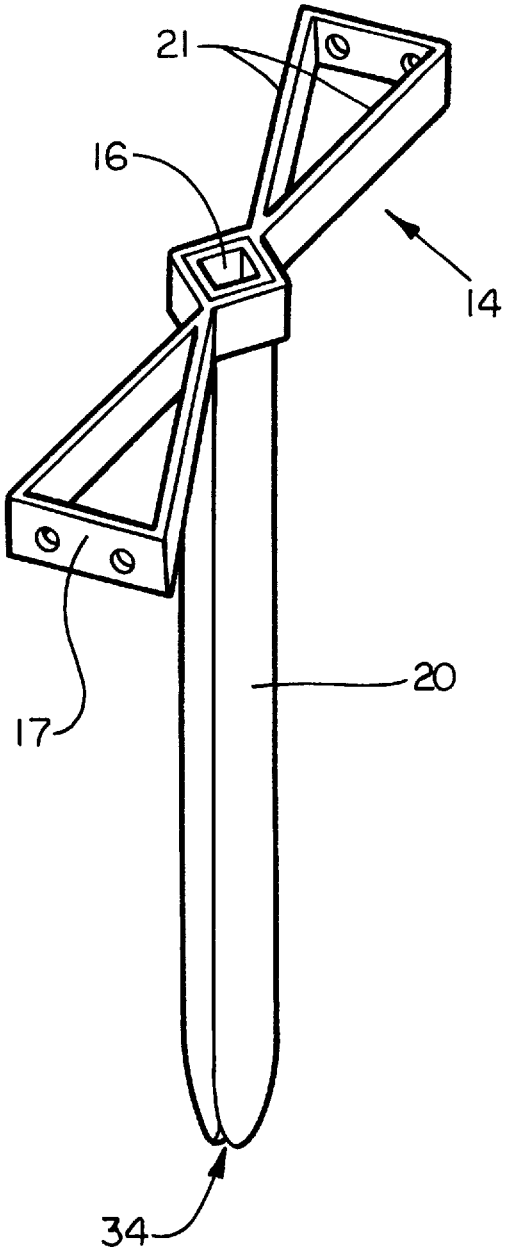
FIG. 4A is a perspective view of the outer support tube with a "bow tie" bracket secured thereto.

One problem which commonly occurs with many conventional chimney damper and cap systems is that, because of the complicated nature of the components of such systems and because the systems often include many different components, air flow through these systems is significantly reduced out of the chimney. This problem is significantly alleviated by the design of the increased air flow bracket (14) of the present invention. See FIG. 4A. The bracket (14) is designed to reduce restriction to air flow caused by its structure while still providing substantial support for the chimney cap (22) and the other components of the system (10). In a preferred embodiment this bracket is manufactured in the form of a "bow tie" as shown in FIG. 4A. In the middle of the bracket is the support tube opening (16) into which the inner (18) and outer (20) support tubes are engaged. On each side of the support tube opening (16) is a V-shaped portion (21). The end portions (17) of each side of the bracket are secured to the inside surface of the support base (12). See FIG. 2. The bracket is formed from conventional coated steel.

By using this simplified structure with few components, the flow of air out of the chimney is not significantly disturbed. In addition, by placing each segment of the bracket on edge, restrictions on air flow are further minimized. In addition, because only the bottom edge of each portion of the bracket (14) is directly contacted by the smoke and soot discharged by the chimney, there is also a reduced buildup of soot and creosote on the bracket, which buildup can reduce the air flow through the chimney damper and cap system (10).

Figure 4B:
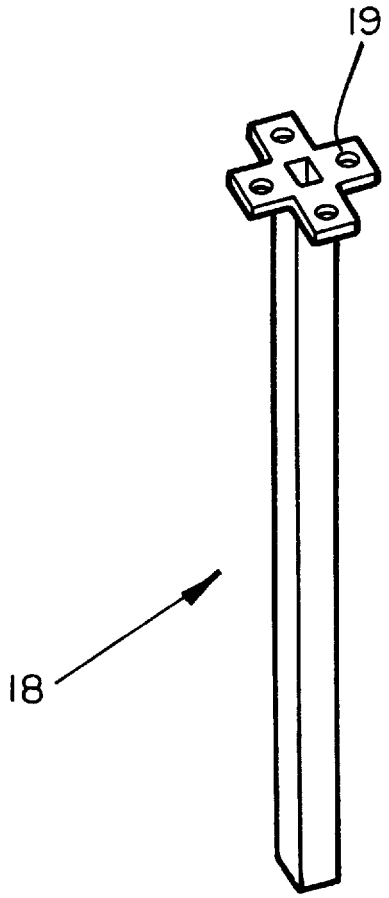
FIG. 4B is a perspective view of the inner support tube.

The chimney cap (22) of the system (10) is supported by the inner support tube (18). See FIG. 4B. The top end (19) of the inner support tube (18) is secured to the inside, bottom surface of the chimney cap (22). The inner tube (18) is secured to the chimney cap (22) by any conventional means such as by bolts or by welding. The bottom end of the inner support tube (18) is slidably engaged within the outer support tube (20).

While the cross-section of the inner and outer support tubes (18, 20) can be in any conventional shape, in a preferred embodiment the cross-section is a regular shape, most preferably square or diamond-shaped. This square or diamond-shaped cross-section is preferred over, for example, a rounded cross-section as it provides a significant restriction on rotation of the chimney cap (22) while in use. This is an especially useful structure to support the chimney cap (22) in conditions of high wind. The size of the cross-section of the inner and outer support tubes (18, 20) is not particularly critical, but preferably the length of a side of the outer support tube is from about ½ of an inch to about 2 inches.

The inner support tube (18) slidably engages within the outer support tube (20) with a close tolerance between these components which still permits unimpeded movement of the inner support tube (18) within the outer support tube (20). In addition, because of this close tolerance between the inner (18) and outer (20) support tubes, the outer surface of the inner support tube (18) is automatically cleaned of soot and creosote by its interaction with the top edge of the outer support tube (20) merely by pulling the inner support tube (18) downward into the outer support tube (20).

The outer support tube (20) is secured within the opening (16) within the increased air flow bracket (14). In a preferred embodiment, the shape of the opening (16) in the bracket (14) is also preferably regular and most preferably square or diamond-shaped and slightly larger than the cross-section of the outer support tube (20). In a most preferred embodiment, the V-shaped portions (21) of the bracket can be separately formed and secured to opposite corners of the diamond-shaped opening (16) in the bracket (14) (see FIG. 4A) or the entire bracket (14) can be formed in a continuous operation. Preferably, the outer support tube (20) is secured within the opening (16) in the increased air flow bracket (14) to provide a secure platform to support the inner support tube (18). The outer support tube (20) is secured in place by conventional securing methods such as welding.

The chimney cap (22) is generally planer in configuration and fabricated from, preferably, a metal sheet or from cast aluminum and preferably weighs about 2 to about 5 pounds. Each side (32) of the chimney cap is deflected downward to deflect any particulate matter which strikes the chimney cap after leaving the chimney flue. In a preferred embodiment, a seal element (not shown) is secured to the bottom surface of the chimney cap (22) at a location where the bottom surface of the chimney cap (22) strikes the top edge of the inner flange (30) of the support base (12) when the chimney cap (22) is pulled against the support base (12). This seal is preferably comprised of conventional materials such as a butadiene rubber and provides a more complete seal of the chimney cap (22) against the support base (12) to reduce the loss of heat up the chimney when the system is in a closed position.

Figure 4C:
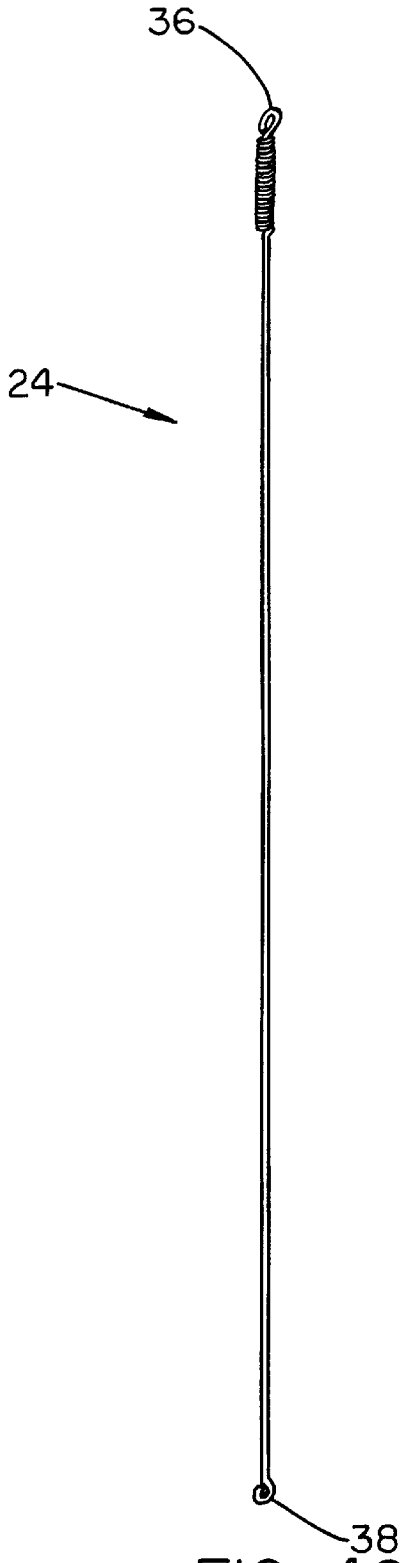
FIG. 4C is a side view of the inner spring.
Figure 4D:
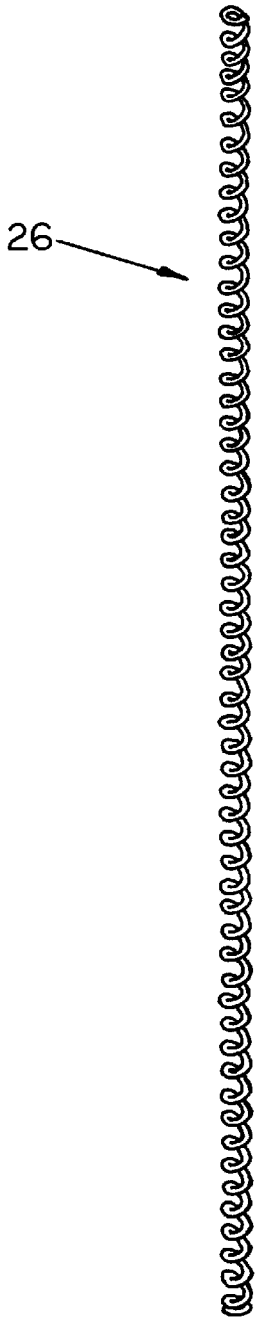
FIG. 4D is a side view of the outer spring.

Located inside of the inner (18) and outer (20) support tubes is the spring system preferably comprising a pair of springs (24, 26). See FIGS. 4C and 4D. In a preferred embodiment the outer spring (26) (FIG. 4D) is a compression spring and the inner spring (24) (FIG. 4C) is an expansion spring. In a preferred embodiment the inner spring (24) fits generally within coils of the outer spring (26). See FIG. 3. To hold these springs within the inner (18) and outer (20) support tubes, the bottom end (34) of the outer support tube (20) is crimped shut, leaving only a small opening through which the bottom end (38) of the inner spring (24) passes. See FIGS. 3 and 4C. Other means than crimping can be utilized to close substantially the opening in the lower end (34) of the outer support tube (20), such as by placing an additional component such as a washer or seal inside the lower end (34) of the outer support tube (20).

The size and spring tension of the outer compression spring (26) should be sufficient to force the chimney cap (22) several inches above the support base (12) when the outer spring (26) is in its relaxed position. Thus, the outer spring should be sufficiently strong with sufficient extension pressure to reliably force the chimney cap (22) to an open position when there is no pressure placed on this outer spring (26). In one preferred embodiment the outer spring is made of spring tempered stainless steel with a wire size ranging from about 0.04 to about 0.12 inch in diameter, with a preferred range from about 0.05 to about 0.10 inch in diameter. The coils of the spring are from about 0.25 to about 0.75 inch in diameter, preferably 0.40 to about 0.60 inch. With these preferred sizes for the coil of the spring, the tension provided by the outer compression spring (26) load can range from about 10 to about 40 pounds depending on the length of the coils. In one particularly preferred embodiment the wire size of the coils of the spring is about 0.062 inches diameter with a 2.19 pounds per inch rate of expansion pressure with a length of coils of about 8 to about 18 inches. This wire spring can support a maximum weight load of at least about 20 pounds.

As stated above, the inner spring (24) is preferably contained within the coils of the outer spring (26). See FIG. 3. The top end (36) of the inner spring (24) is preferably secured to the bottom surface of the chimney cap (22) inside of the top end (19) of the inner support tube (18). The damper cable (28) is then secured to the bottom end (38) of the inner spring. The inner spring or extension spring is also made of a spring tempered stainless steel. Its wire size is preferably about 0.03 to about 0.08 inch in diameter with the coils having a diameter of about 0.25 to about 0.50 inch. With a length of the coils about 4 to 8 inches, springs of this size will support a maximum load of about 11 pounds to about 45 pounds. In a particularly preferred embodiment, the wire size for this type of extension spring is about 0.06 at 3.88 pounds per inch with a maximum load of about 22 pounds.

In a relaxed position, the coils of the inner spring are generally from about ⅙ to about ½ the longitudinal length of the outer spring (26) when the outer spring (26) is in a relaxed position. See FIG. 4C. In one preferred embodiment the coils of the outer spring (26) are about 18 inches in longitudinal length while the coils of the inner spring (24) are about 2 to 9 inches in longitudinal length when both are in relaxed positions. When the inner spring (24) is expanded by pulling on the damper cable (28), the inner spring (24) expands within the coils of the outer spring (26). As the inner spring (24) expands, the chimney cap (22) is pulled downward putting compression pressure on the outer spring (26). The outer spring (26) is then compressed within the inner (18) and outer (20) support tubes by the action of the chimney cap (22) being pulled downward. Because the chimney cap (22) must be capable of being closed by the interaction of the inner and outer springs, it is critical that the coils of the inner spring (24) be able to expand, even while the outer spring (26) compresses, to pull the chimney cap (22) downward to a closed position. Thus, in a preferred embodiment, the strength of the inner spring (24) must be at least about 5 percent stronger, probably 10 to 70 percent stronger, than that of the outer spring (26).

Figure 5:
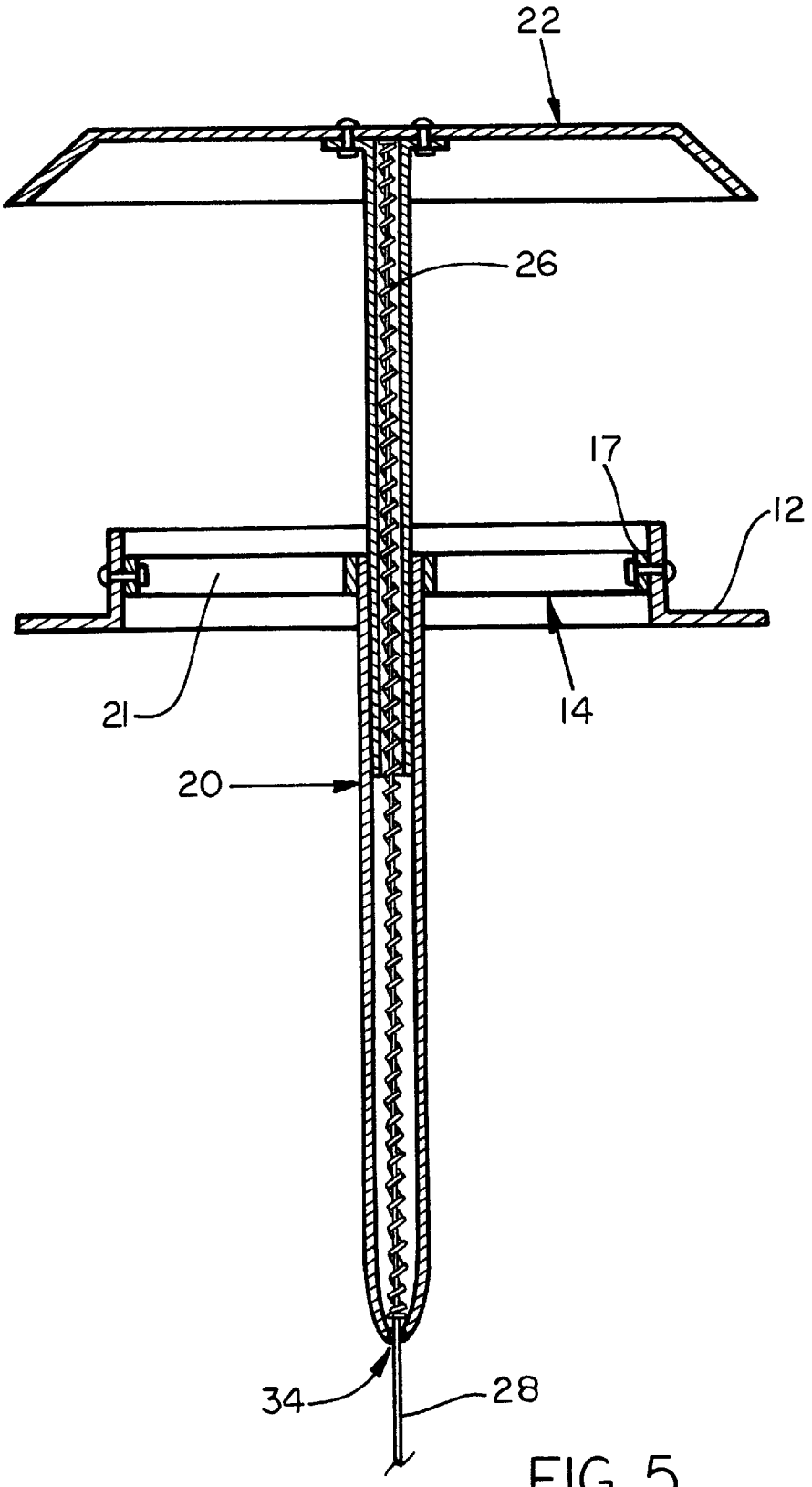
FIG. 5 is a cut away side view of the chimney damper and cap system showing an alternative embodiment utilizing a single spring.

In an alternative less preferred embodiment, no inner spring is utilized. See FIG. 5. In this embodiment the damper cable (28) is connected directly to the bottom surface of the chimney cap (22). The chimney cap (22) is pulled downward directly by the damper cable (28). The downward movement caused by the pull of the damper cable compresses the outer spring (26) located within the inner support tube (18).

However, the preferred embodiment provides significant advantages over this less preferred, single spring embodiment. When using the inner (24) and outer (26) spring embodiment, the chimney cap (22) can be pulled tightly against the top surface of the support base (12). At this point, additional downward force can be applied to the damper cable which further expands the inner spring (24). This assures a complete and tight closing of the chimney and also makes it easier to secure the damper cable in place as will be discussed in the next paragraph.

As above stated, in the preferred embodiment the damper cable (28) is secured to the bottom end (38) of the inner spring (24). The damper cable (28) extends downward into the chimney to the fireplace opening. The cable is conventional as is disclosed, for example, in U.S. Pat. Nos. 3,945,307 and 4,165,679. The chimney cap (22) remains closed when the damper cable (28) is secured in place to a latch element (40) secured in the chimney, which element is well known in the industry. As discussed above, after the chimney cap (22) is pulled tightly against the support base (12), additional force can be applied to the damper cable (28) which will then permit the chimney cap (22) to be secured tightly shut. In addition, because of the natural expansion force supplied by the outer spring (26), the chimney cap (22) will return to an open position when the downward force supplied by the damper cable (28) on the inner spring (24) is removed.

In a further alternative embodiment, a support arm (not shown) may be secured to the bottom of the support base (12). This support arm contains an opening through which the damper cable (28) passes. While the support arm is described as an extended arm having an opening, the support arm may also take the form of a tube or other means such as a bottom eyelet which has a fixed bottom opening through which the cable (28) may pass. The support arm serves the function of assisting in the proper closing of the chimney cap (22). Even if the cable (28), after passing through the support arm, is directed to one side of the flue by the placement of the opening in the support arm directly below the bracket (14) which secures the damper cable (28) to the inner spring (24), the chimney cap can be closed securely around all edges.

In operation, the support base (12) is placed on the top of a chimney and secured in place by a conventional securing means. In an alternative embodiment, a sleeve element (not shown) of the support base may be secured to the inside surface of the chimney. In normal operation of the chimney damper and cap system (10), the chimney cap (22) is biased to an open position by the expansion forces of the outer spring (26). To close the chimney cap (22), the damper cable (28) is pulled and fastened to the latch element (40) located near the fireplace. As downward forces are placed on the inner spring (24) by pulling the damper cable (28), the inner spring (24) transfers this force to the chimney cap (22) thus pulling it downward until it is secured tightly against the upper edges of the support base (12). Because the strength of the inner spring (24) is greater than that of the outer spring (26), this downward force overcomes the expansion pressure supplied by the inner spring (24). Upon release of damper cable (28) from the latch element, the outer spring (26)

biases the chimney cap (22) away from the surface of the support base (12). Thus, in the event that the damper cable (28) breaks, the chimney cap (22) will always "fail safe" to an open position because of the extension pressure of the outer spring (26) acting against the chimney cap (22).

I claim:

1. A chimney damper and cap system for use on a chimney flue comprising (a) a support base, secured to the chimney flue;

(b) an increased air flow bracket secured to the support base containing a support tube securing element;

(c) a support tube system secured to the bracket;

(d) a spring system comprising an inner spring and an outer spring contained within the support tube system;

(e) a damper cable secured to the spring system; and (f) a chimney cap secured to the support tube system.

2. The chimney damper and cap system of claim 1 wherein the bracket comprises a bow tie-shaped bracket containing a support tube opening.

3. The chimney damper and cap system of claim 1 wherein the inner spring is substantially contained within coils of the outer spring.

4. The chimney damper and cap system of claim 1 wherein the inner spring is an expansion spring and the outer spring is a compression spring.

5. The chimney damper and cap system of claim 1 wherein the support tube system comprises an inner and an outer support tube.

6. The chimney damper and cap system of claim 5 wherein an end of the outer support tube is substantially closed except for an opening through which the damper cable passes.

7. The chimney damper and cap system of claim 5 wherein the cross-section of the inner and outer support tubes is generally square.

8. The chimney damper and cap system of claim 1 wherein the longitudinal length of coils of the inner spring at rest is less than about 50 percent of the longitudinal length of coils of the outer spring at rest.

9. The chimney cap system of claim 5 wherein the outer support tube is secured within an opening in the bow-tie shaped bracket.

10. The chimney cap system of claim 2 wherein the bow tie-shaped bracket comprises a pair of V-shaped portions, a pair of end portions and a support tube opening.

11. The chimney cap system of claim 9 wherein the chimney cable is secured to the chimney cap.

12. The chimney cap system of claim 1 wherein the chimney cable is secured to the spring means.

13. The chimney cap system of claim 1 wherein the chimney cable is secured to the inner spring.

14. The chimney cap system of claim 5 wherein the inner support tube is secured to the chimney cap.

15. The chimney cap system of claim 1 wherein a force against expansion of the inner spring is at least about 10 percent stronger than a force against compression of the outer spring.

* * * * *